US011731432B2

(12) United States Patent
Ishikawa

(10) Patent No.: US 11,731,432 B2
(45) Date of Patent: Aug. 22, 2023

(54) LIQUID CONTAINER AND LIQUID EJECTING APPARATUS

(71) Applicant: CANON KABUSHIKI KAISHA, Tokyo (JP)

(72) Inventor: Masashi Ishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 17/533,723

(22) Filed: Nov. 23, 2021

(65) Prior Publication Data

US 2022/0203692 A1 Jun. 30, 2022

(30) Foreign Application Priority Data

Dec. 28, 2020 (JP) ..... 2020-218730

(51) Int. Cl.
*B41J 2/175* (2006.01)

(52) U.S. Cl.
CPC .. *B41J 2/17513* (2013.01); *B41J 2002/17516* (2013.01)

(58) Field of Classification Search
CPC ..... B41J 2/17503; B41J 2/17509; B41J 2/17513; B41J 2/1752; B41J 2/17523; B41J 2/17553
See application file for complete search history.

(56) References Cited

U.S. PATENT DOCUMENTS

| | | | | |
|---|---|---|---|---|
| 10,675,875 | B2 | 6/2020 | Nagashima | B41J 2/175 |
| 11,141,986 | B2 * | 10/2021 | Katsuki | B41J 2/17526 |
| 2017/0173966 | A1 * | 6/2017 | Kawate | B41J 2/17506 |
| 2018/0104955 | A1 * | 4/2018 | Kawate | B41J 29/13 |

FOREIGN PATENT DOCUMENTS

| | | |
|---|---|---|
| JP | 2019-107823 | 7/2019 |

* cited by examiner

*Primary Examiner* — Anh T Vo
(74) *Attorney, Agent, or Firm* — Venable LLP

(57) ABSTRACT

To supply a liquid at a stable concentration, a liquid container includes a liquid container bag which contains a liquid, a spacer member which is disposed inside the liquid container bag, liquid introducing portions which are disposed in the spacer member and introduce the liquid, a liquid delivery member which is fixed to one end portion of the liquid container bag and delivers the liquid introduced from the liquid introducing portions to a liquid ejecting apparatus, and a low rigidity portion which changes heights of the liquid introducing portions along with deformation of the liquid container bag.

9 Claims, 11 Drawing Sheets

FIG.3A
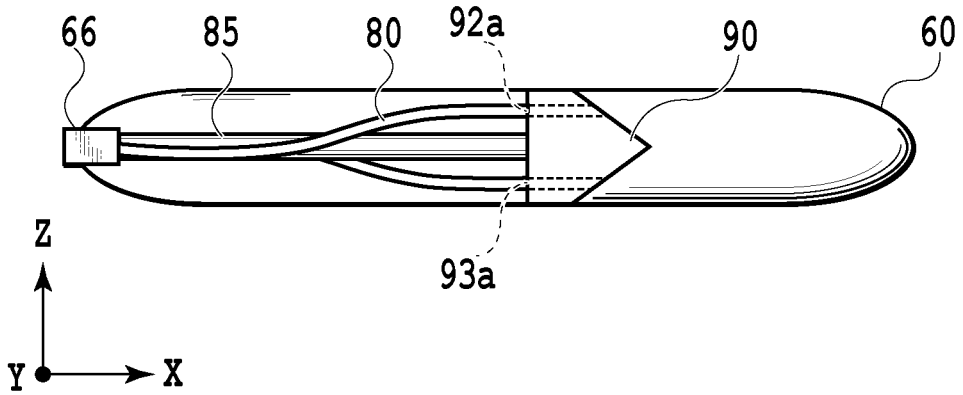
FIG.3B
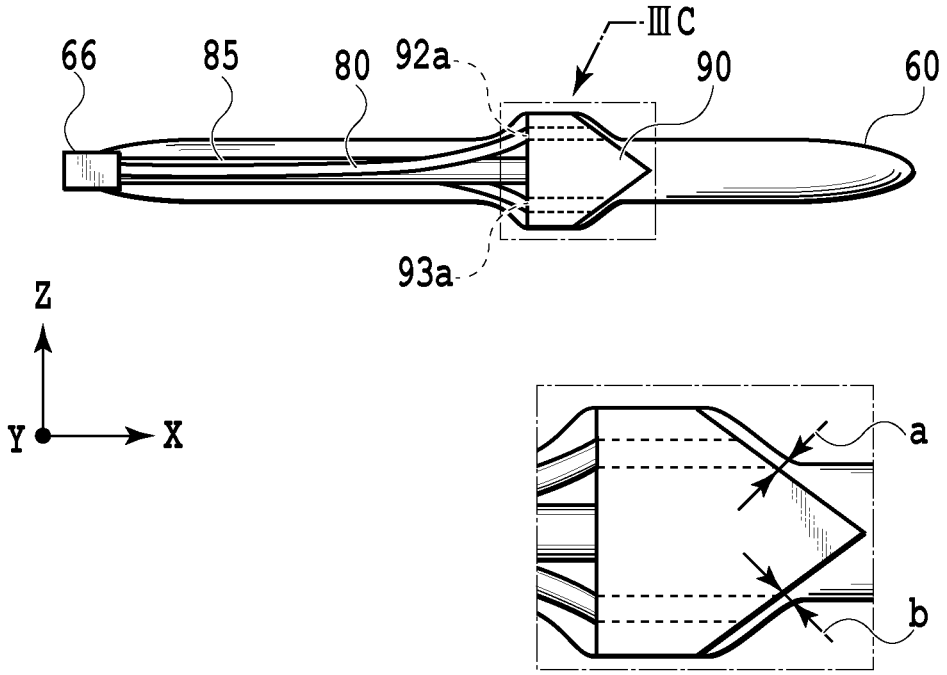
FIG.3C

LIQUID CONTAINER AND LIQUID EJECTING APPARATUS

BACKGROUND OF THE INVENTION

Field of the Invention

The present invention relates to a technique for a liquid container that supplies a liquid to a liquid ejecting apparatus.

Description of the Related Art

Liquid containers for supplying liquid to a liquid ejecting apparatuses have been widely used to date. Japanese Patent Laid-Open No. 2019-107823 discloses a liquid container for supplying a liquid containing a precipitate component at a stable concentration. Specifically, Japanese Patent Laid-Open No. 2019-107823 discloses the liquid container which includes two liquid delivery tubes and is configured to introduce a liquid from two locations different in height in a liquid container bag.

However, in the technique disclosed in Japanese Patent Laid-Open No. 2019-107823, a spacer member may block deformation of the liquid container bag along with consumption of the liquid, whereby a concentration balance of the supplied liquid may be lost.

An object of the present invention is to supply a liquid in a stable concentration balance.

SUMMARY OF THE INVENTION

A liquid container according to an aspect of the present invention includes a liquid container bag configured to contain a liquid, a spacer member disposed inside the liquid container bag, liquid introducing portions disposed in the spacer member and configured to introduce the liquid, a liquid delivery member fixed to one end portion of the liquid container bag and configured to deliver the liquid introduced from the liquid introducing portions to a liquid ejecting apparatus, and a low rigidity portion configured to change heights of the liquid introducing portions along with deformation of the liquid container bag.

Further features of the present invention will become apparent from the following description of exemplary embodiments with reference to the attached drawings.

BRIEF DESCRIPTION OF THE DRAWINGS

FIGS. 3A to 3C are schematic side views showing a problem of the comparative example;

DESCRIPTION OF THE EMBODIMENTS

Prior to a description of a liquid container according to an embodiment, a liquid container such as the one disclosed in Japanese Patent Laid-Open No. 2019-107823 will be described as a comparative example. The liquid container of this embodiment will be described thereafter.

Figure 1:
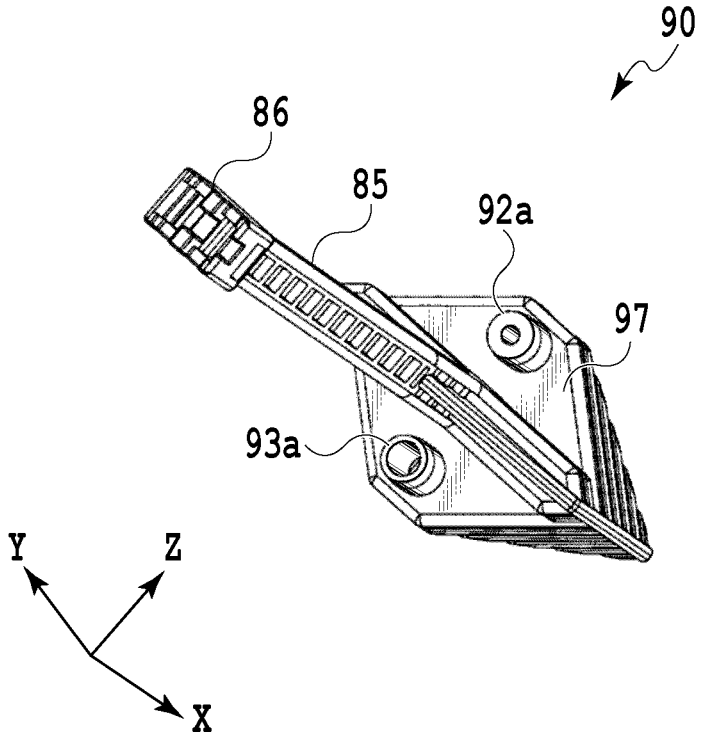
FIG. 1 is a schematic perspective view of a spacer member of a comparative example.
Figure 2:
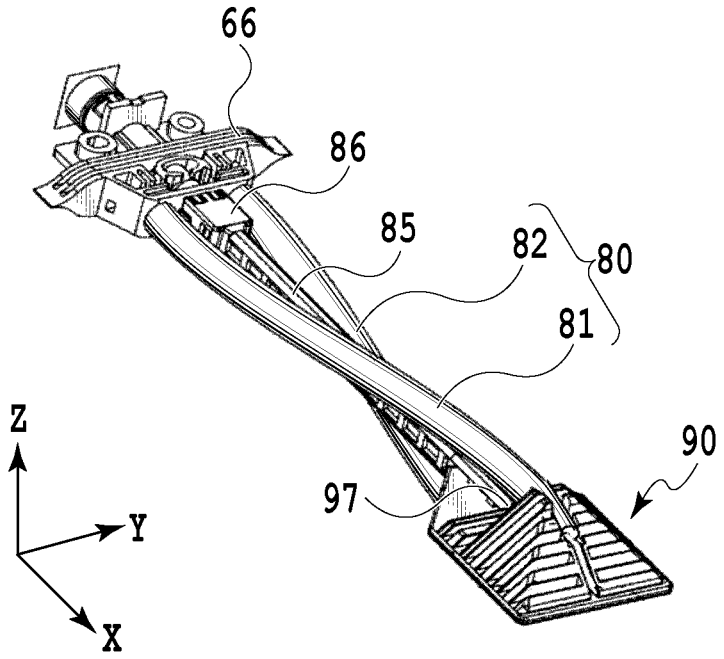
FIG. 2 is a schematic perspective view of a configuration including the spacer member, a connecting member, and a liquid delivery member of the comparative example.

FIG. 1 is a schematic perspective view showing a configuration of a spacer member 90 and a connecting member 85 of the comparative example. Meanwhile, FIG. 2 is a schematic perspective view of a configuration of the comparative example including the spacer member 90, the connecting member 85, a liquid delivery member 66, and liquid delivery tubes 80. In FIG. 1, the z direction represents a vertical direction, and the liquid container is attached to a liquid ejecting apparatus in a state of setting its upper part in the +z direction while setting its lower part in the −z direction.

The liquid delivery tubes 80 include a first delivery tube portion 81 and a second delivery tube portion 82, and connecting tubes 92*a* and 93*a* for connecting the liquid delivery tubes 80 are provided at a rear surface portion 97 of the spacer member 90. The connecting tubes 92*a* and 93*a* penetrate the spacer member 90 in the x direction. A liquid is introduced via these through holes. The liquid is passed through the liquid delivery tubes 80 and supplied to the liquid delivery member 66. By locating the connecting tube 92*a* at a position higher than the connecting tube 93*a*, a portion of the liquid having a low concentration of a precipitate component is introduced from the connecting tube 92*a* while a portion of the liquid having a high concentration of the precipitate component is introduced from the connecting tube 93*a*. Then, these portions of the liquid join together in the liquid delivery member 66 to obtain the liquid at a desired concentration.

As shown in FIGS. 3A and 3B, the spacer member 90 is the highest in the z direction among internal structural components of a liquid container bag 60. In a case where a prescribed amount of the liquid is sealed in the liquid container bag 60, both the lowermost part and the upper most part of the spacer member 90 come into contact with an internal surface of the liquid container bag 60. This configuration makes it possible to introduce the precipitate component at different concentrations. The liquid container having the above-described configuration can supply the liquid in a stable concentration balance in an initial filled state. However, as the liquid is consumed, the spacer member 90 may block deformation of the liquid container bag 60 whereby a concentration balance of the supplied liquid may be lost.

FIGS. 3A and 3B are diagrams showing a problem of the liquid container of the above-described configuration. FIG. 3A shows an initial state where the prescribed amount of the liquid is sealed in the liquid container bag 60. Meanwhile, FIG. 3B shows a state after the liquid is consumed. FIG. 3C shows an enlarged view of FIG. 3B. Each of FIGS. 3A and 3B is a schematic diagram which sees through the liquid container in the −y direction for the convenience of description. In the initial state, it is possible to introduce the portions of the liquid at a desired proportion from the connecting tubes 92*a* and 93*a*. On the other hand, as the liquid is consumed, the liquid container bag 60 is deformed in such a way as to follow the shape of the spacer member 90. In this instance, the liquid container bag 60 may develop creases and spaces between the through hole of the connecting tube 92*a* and the liquid container bag 60 and between the through hole of the connecting tube 93*a* and the liquid container bag 60 may get out of balance as shown in FIG. 3B. As a consequence, there may be a difference in ease of flow of the liquid supplied to the connecting tubes 92*a* and 93*a*, which may result in a failure to introduce the liquid at the desired proportion.

First Embodiment

A first embodiment of the present invention will be described below with reference to the accompanying drawings. Note that the following description will be given on the assumption that the liquid used therein is an ink that contains a precipitate component. In reality, however, the liquid is not limited only to the ink but may be any liquid containing a precipitate component. The x direction is a direction in which a liquid container 20 moves back and forth relative to a liquid ejecting apparatus 100 in a case where the liquid container 20 is attached to or detached from the liquid ejecting apparatus 100. The y direction is a width direction of the liquid container 20, which is a direction orthogonal to the x direction on a horizontal plane. The z direction is a thickness direction of the liquid container 20. The z direction is also orthogonal to the x direction and the y direction. A state where the liquid container 20 is mounted on the liquid ejecting apparatus 100 will be referred to as a mounted state. The liquid container 20 is mounted on the liquid ejecting apparatus 100 in such an orientation that the thickness direction of the liquid container 20 coincides with the vertical direction. As a consequence, the z direction coincides with the vertical direction in the mounted state.

Figure 4:
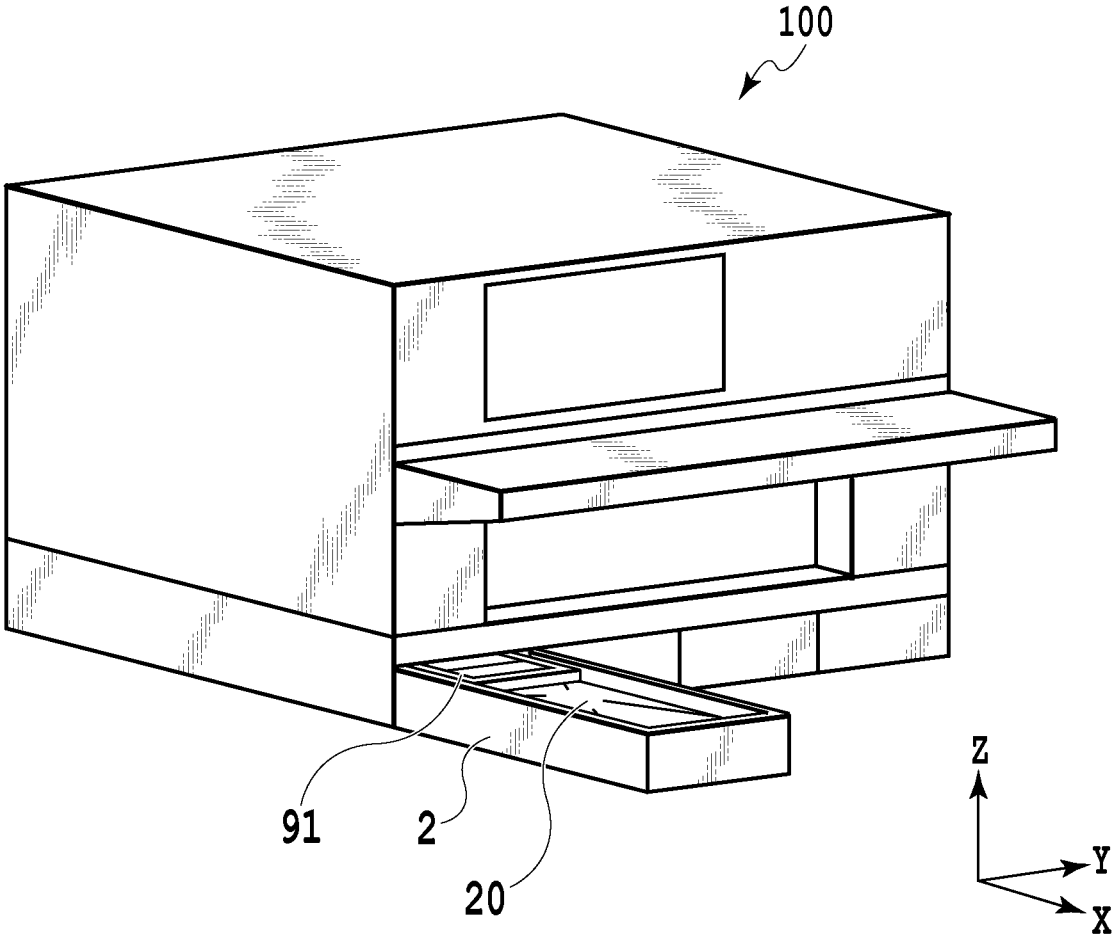
FIG. 4 is a perspective view of a liquid ejecting apparatus mounting a liquid container.

FIG. 4 is a perspective view of the liquid ejecting apparatus 100 mounting the liquid containers 20. The liquid containers 20 housed in a cassette 2 are mounted on a holding member 91 of the liquid ejecting apparatus 100. Each liquid container 20 contains an ink to be ejected from a liquid ejecting unit of the liquid ejecting apparatus 100. In this embodiment, four liquid containers 20 that contain cyan (C), magenta (M), yellow (Y), and black (K) inks, respectively, are mounted on the liquid ejecting apparatus 100. Although the four liquid containers 20 have the same size, the liquid container 20 for the black ink may be formed larger than the liquid containers 20 containing the inks of other colors, for example. Meanwhile, the cassette 2 housing the liquid container 20 moves in the x direction relative to the liquid ejecting apparatus 100, and is attachable to and detachable from the liquid ejecting apparatus 100.

Meanwhile, the liquid ejecting apparatus 100 may be provided with multiple liquid containers and one or more of the liquid containers among them may be the liquid containers 20 having the configuration described in this embodiment.

Note that a configuration of a print head generally used for an inkjet printing apparatus may be adopted as a configuration of a printing unit of the liquid ejecting apparatus 100. As for the type of the print head, it is possible to adopt a scan type which is configured to repeat reciprocation of a print head for scanning a print medium across a print width thereof and conveyance of the print medium for a length of a print height after the scanning, or a so-called page wide type which is provided with nozzles across the print width of the print medium, for example.

Figure 5A:
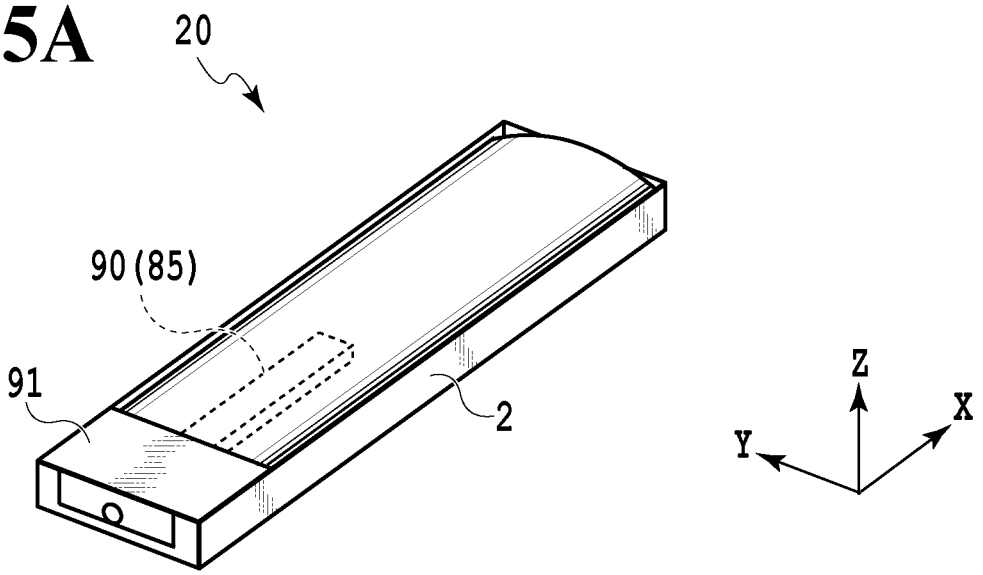
FIG. 5A is a perspective view of the liquid container and FIG. 5B is an exploded perspective view showing procedures for assembling the liquid container.
Figure 5B:
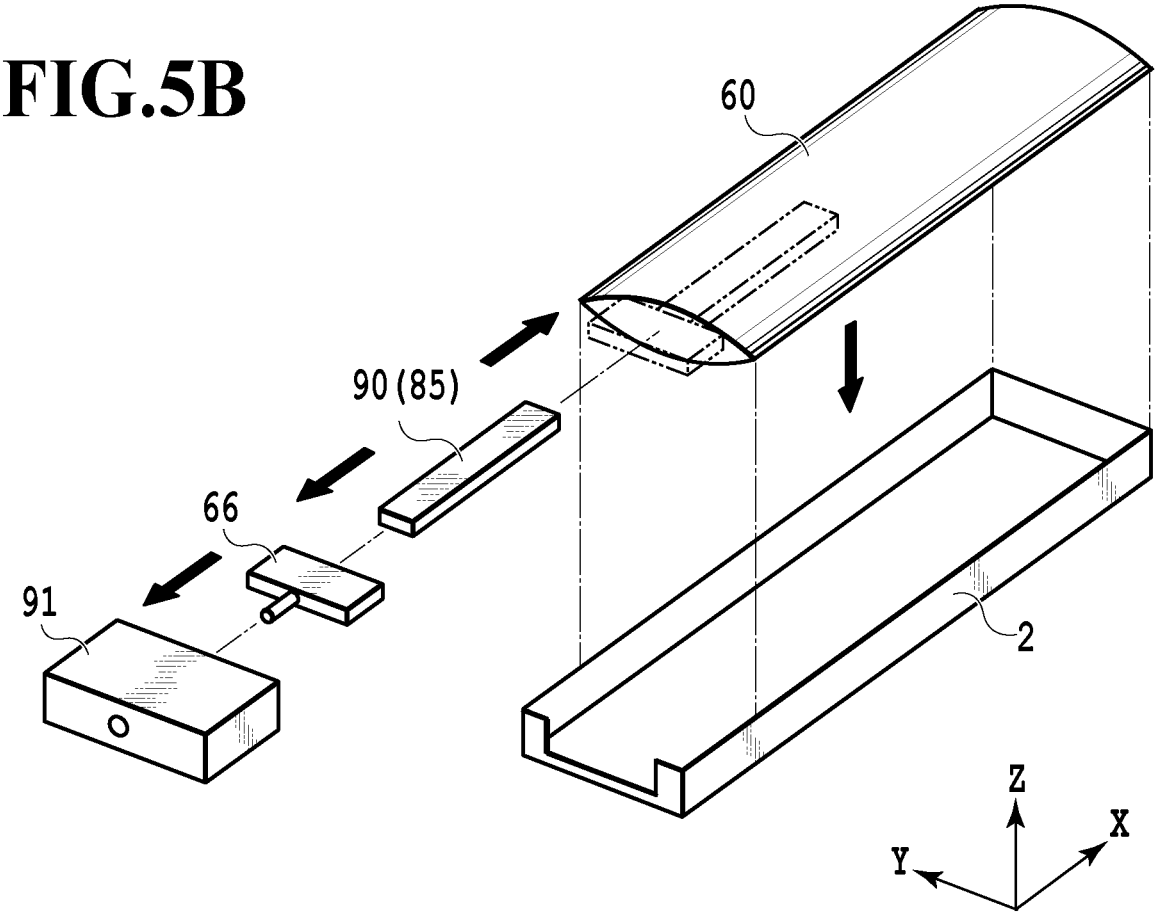

FIGS. 5A and 5B are perspective views of the liquid container 20. FIG. 5A is a perspective view showing a state where the liquid container 20 is housed in the cassette 2. FIG. 5B is an exploded perspective view showing procedures for assembling the liquid container 20. The spacer member 90 and the connecting member 85 (which is simply illustrated) are connected to the liquid delivery member 66, and then connected to the holding member 91, the liquid container bag 60, and the cassette 2.

Figure 6:
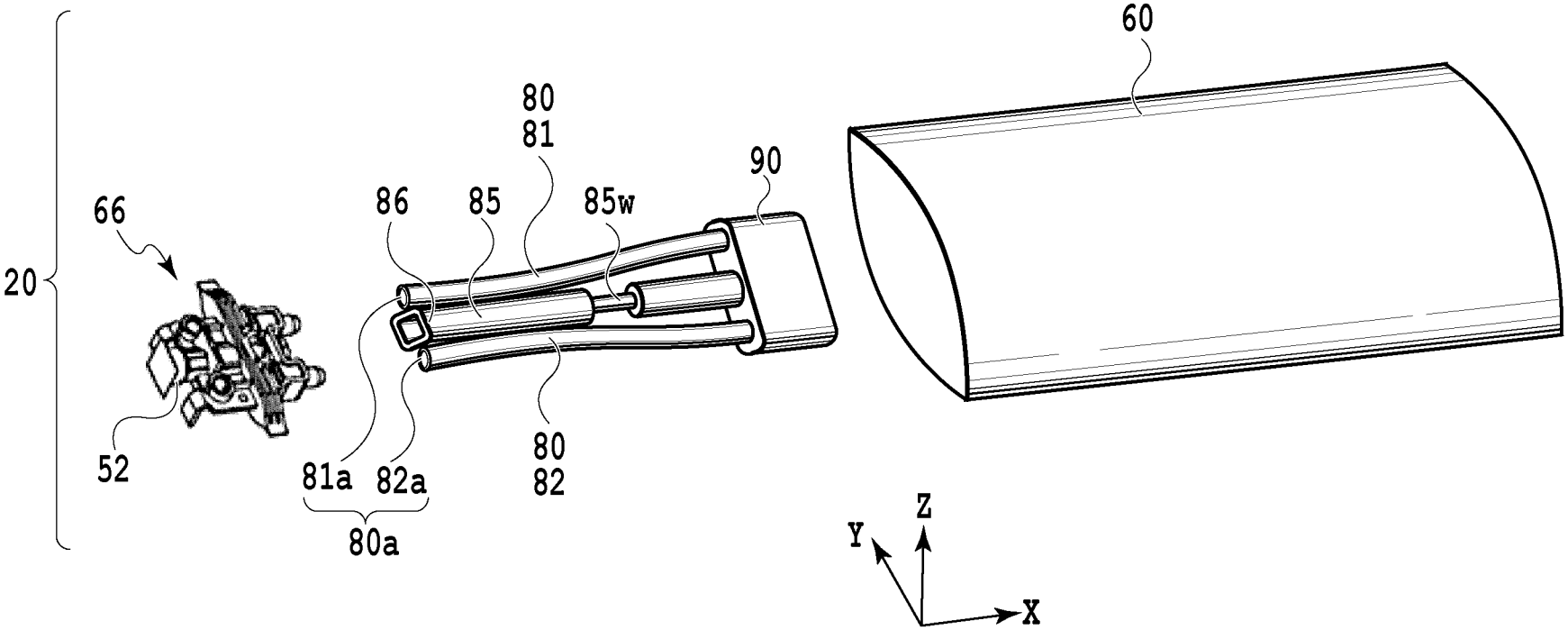
FIG. 6 is a schematic exploded perspective view showing a state of taking out an internal structure of the liquid container.

FIG. 6 is a schematic exploded perspective view showing a state of taking out an internal structure out of the liquid container bag 60. The internal structure includes the liquid delivery tubes 80, the connecting member 85, and the spacer member 90. The internal structure in a state of being connected to the liquid delivery member 66 is attached into the liquid container bag 60 through an opening provided in advance at one end portion of the liquid container bag 60. Since this embodiment assumes a case where the liquid precipitates in the z direction (the thickness direction), the liquid container bag 60 is assumed to contract mainly in the z direction. The liquid delivery tubes 80 constitute circulation passages to circulate the liquid inside the liquid container bag 60. Each liquid delivery tube 80 is formed from an elastic tube made of an elastomer, for example. In this embodiment, the liquid delivery tubes 80 include the first delivery tube portion 81 and the second delivery tube portion 82, and are thus formed from two tubes. The liquid delivery tubes 80 include base end portions 80*a* connected to the liquid delivery member 66 inside the liquid container bag 60. The base end portions 80*a* include a first base end portion 81*a* of the first delivery tube portion 81 and a second base end portion 82*a* of the second delivery tube portion 82. Flow channels for establishing communication between the liquid delivery tubes 80 and a liquid delivery unit 52 are formed inside the liquid delivery member 66 (not illustrated in FIG. 6).

Each liquid delivery tube 80 extends from the spacer member 90 toward the liquid delivery member 66 disposed inside the liquid container bag 60. The spacer member 90 is a structure for defining a region having a prescribed volume inside the liquid container bag 60. The spacer member 90 is made of a synthetic resin such as polyethylene and polypropylene. The spacer member 90 is fixed to the liquid delivery member 66 by using the rod-like connecting member 85. A lock portion 86 for fixing the connecting member 85 to the liquid delivery member 66 is provided at an end portion of the connecting member 85. The connecting member 85 extends in the x direction along a center axis of the liquid delivery unit 52. The connecting member 85 is connected to the liquid delivery member 66 by using the lock portion 86 provided at the end portion on the −x direction side, and an end portion on the +x direction side is connected to the spacer member 90. The connecting member 85 may be made of the same synthetic resin as the spacer member 90, or made of a different material.

Figure 7A:
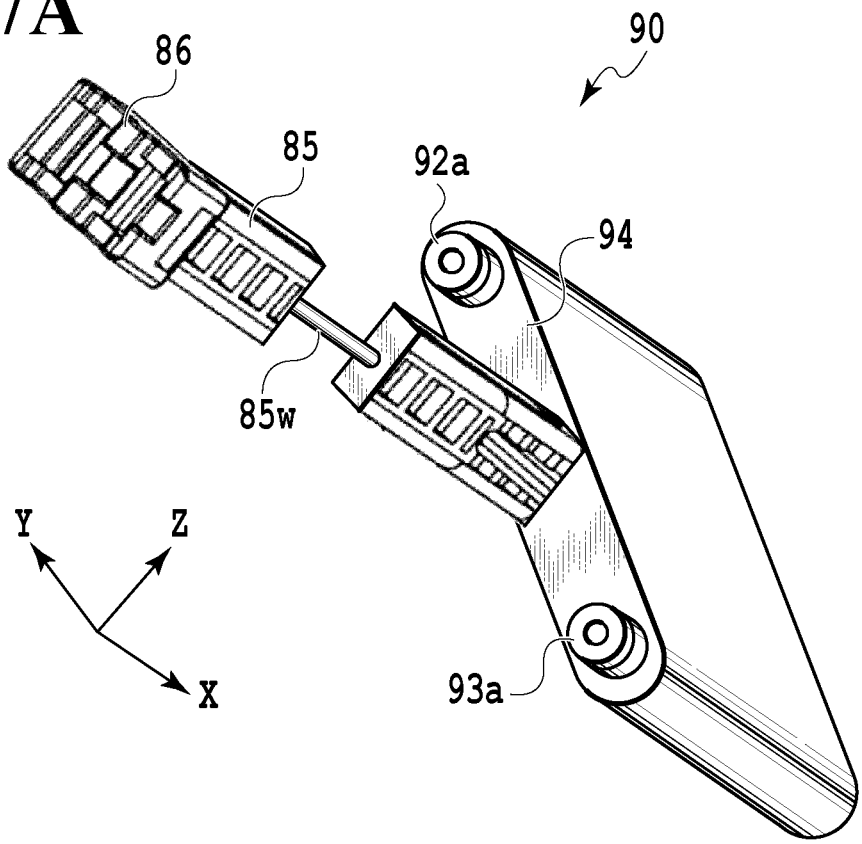
FIGS. 7A and 7B are schematic perspective views of a spacer member.
Figure 7B:
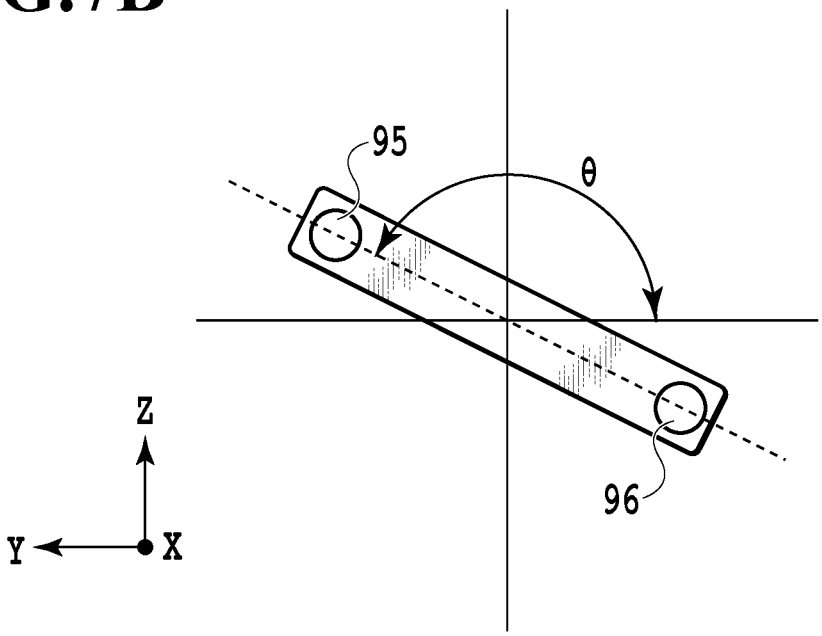

FIGS. 7A and 7B are schematic perspective views of the spacer member 90 and the connecting member 85. FIG. 7A is a perspective view showing configurations of the spacer member 90 and the connecting member 85 of the present invention. Meanwhile, FIG. 7B is a diagram viewing the spacer member 90 from the +x direction to the −x direction. The spacer member 90 has an inclination just by an angle θ relative to the horizontal plane. Meanwhile, liquid introducing portions 95 and 96 are openings provided at end portions in the +x direction of the liquid delivery tubes 80 serving as the flow channels from the inside of the liquid container bag 60 to the liquid delivery member 66. The liquid introducing portions 95 and 96 are distinguished from each other and play different roles from each other. The liquid introducing portion 95 is the opening which is joined to the first delivery tube portion 81 and introduces a portion of the liquid at a low concentration. On the other hand, the liquid introducing portion 96 is the opening which is joined to the second delivery tube portion 82 and introduces a portion of the liquid at a high concentration. FIGS. 7A and 7B illustrate an example in which the liquid introducing portions 95 and 96 are provided at an end portion in the x direction of the spacer member 90. However, locations where to provide the liquid introducing portions 95 and 96 are not limited to the end portion in the x direction of the spacer member 90. For example, the locations where to provide the liquid introducing portions 95 and 96 may be an end portion in the y direction or the spacer member 90 and the like as long as the contraction of the liquid container bag 60 does not have a negative impact on the flow of the liquid and the liquid introducing portions 95 and 96 can deliver the portions of the liquid with the difference in concentration. Moreover, the liquid introducing portions 95 and 96 do not always have to be provided at two ends of the spacer member 90 but may be provided at other locations as long as such locations can satisfy the aforementioned conditions. The spacer member 90 has a substantially rectangular shape in terms of a y-z plane, and its corner portions may have rounded shapes as appropriate.

As shown in FIG. 7B, in this embodiment, the spacer member 90 is formed by providing the inclination in advance. Instead, the spacer member 90 may be inclined by providing a lock portion as with the fixation of the liquid delivery member 66 and the connecting member 85. While an angle θ may be set to any value as appropriate, the angle is preferably set such that the thickness of the liquid container bag 60 in a case of sealing the prescribed amount of the liquid in the liquid container bag 60 is equal to the height in the z direction of the spacer member 90. The locations of the connecting tubes 92*a* and 93*a* of the spacer member 90 may be set to any positions as appropriate. However, in the case where these locations are closer to the end portions, there is a more difference in height between these tubes in the liquid container bag 60. Accordingly, it is easier to supply the precipitated liquid.

The connecting member 85 includes a low rigidity portion 85*w* in part in the x direction. The low rigidity cited herein represents a rigidity with which a force received by the spacer member 90 in consequence of deformation of the liquid container bag 60 brings about torsional deformation of the connecting member 85. In this embodiment, polyethylene is used as the material while setting its modulus of rigidity to 0.26 GPa. As for the shape, a diameter is set to 1.5 mm and a length is set to 10 mm. Thus, the connecting member 85 has such a rigidity that develops torsion in an amount of about 45° with a moment of rotation of 10 N·mm.

Figure 8A:
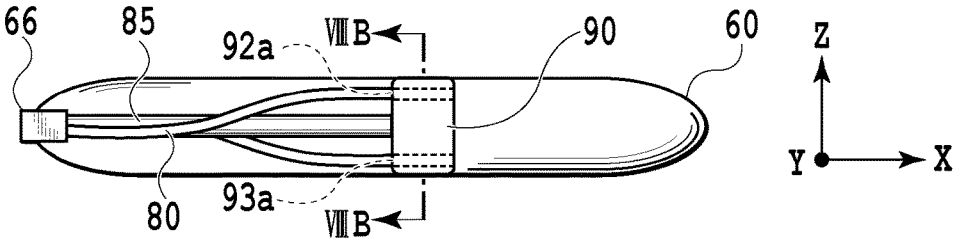
FIGS. 8A to 8F are schematic diagrams showing a deformation process of the liquid container bag.
Figure 8B:
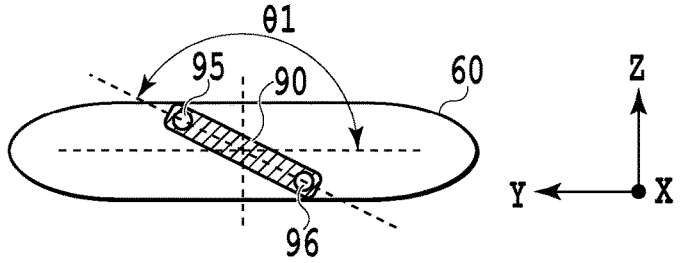
Figure 8C:
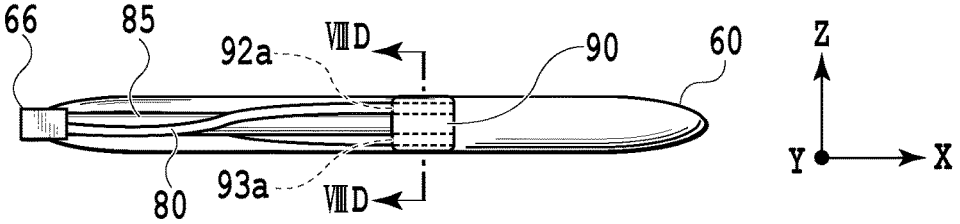
Figure 8D:
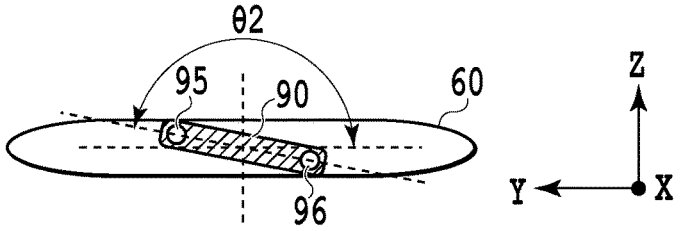
Figure 8E:
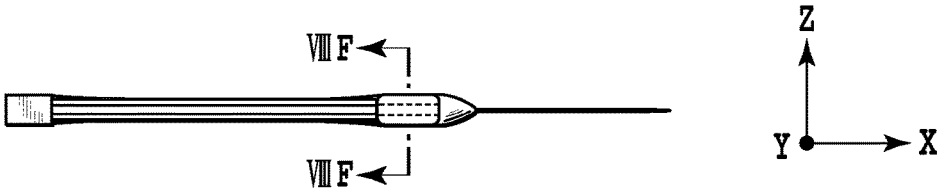
Figure 8F:
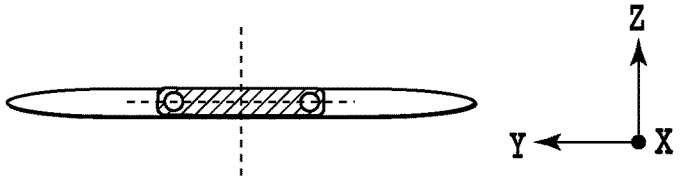

FIGS. 8A to 8F show states of the liquid container bag 60 and the spacer member 90 in a liquid consumption process. FIGS. 8A and 8B show an initial filled state of the liquid container bag 60 containing the liquid, in which the spacer member 90 is inclined by an angle $\theta_1$ (about 140°, for example). FIGS. 8C and 8D show a state where about a half of the ink is consumed. Here, the low rigidity portion 85*w* develops the torsion along with the deformation of the liquid container bag 60, and the inclination of the spacer member 90 is increased to an angle $\theta_2$ close to a horizontal line (about 170°). This low rigidity portion 85*w* has such a rigidity that develops the torsion by the contracting force of the liquid container bag 60. As a consequence, the spacer member 90 does not block the contracting movement of the liquid container bag 60 and the liquid introducing portions 95 and 96 of the spacer member 90 are not blocked by the liquid container bag 60 either. The difference in height between an upper end portion and a lower end portion of the spacer member 90 becomes less as the liquid container bag 60 contracts more, and the value of the angle θ also grows larger accordingly. FIGS. 8E and 8F show a state where the ink is depleted. Here, the spacer member 90 is made horizontal (180°) without any inclination.

As described above, according to this embodiment, it is possible to supply the liquid at a stable concentration. To be more precise, a change in inclination of the spacer member 90 brings about a suitable difference in height between the liquid introducing portions 95 and 96 at any degree of consumption of the liquid in the liquid container bag 60, thereby supplying the portions of the liquid having the difference in concentration. Meanwhile, the low rigidity portion 85*w* develops the torsion along with the deformation of the liquid container bag 60, whereby the height in the z direction of the spacer member 90 is reduced and the liquid container bag 60 is deformed smoothly. For this reason, the liquid introducing portions 95 and 96 are less likely to be blocked by the liquid container bag 60, so that the portions of the liquid can be supplied to the liquid ejecting apparatus 100 in a stable concentration balance. Although this embodiment is configured to turn the spacer member 90 until the spacer member 90 is horizontal. Nevertheless, an advantageous effect is also available by causing the torsion just a little.

Second Embodiment

This embodiment will describe a configuration to deform low rigidity portions 94 provided to the spacer member 90. While this embodiment will be described with reference to FIGS. 9 to 10F, the constituents in FIGS. 9 to 10F denoted by the same reference signs as those in the first embodiment have the same functions and explanations thereof will be omitted.

Figure 9:
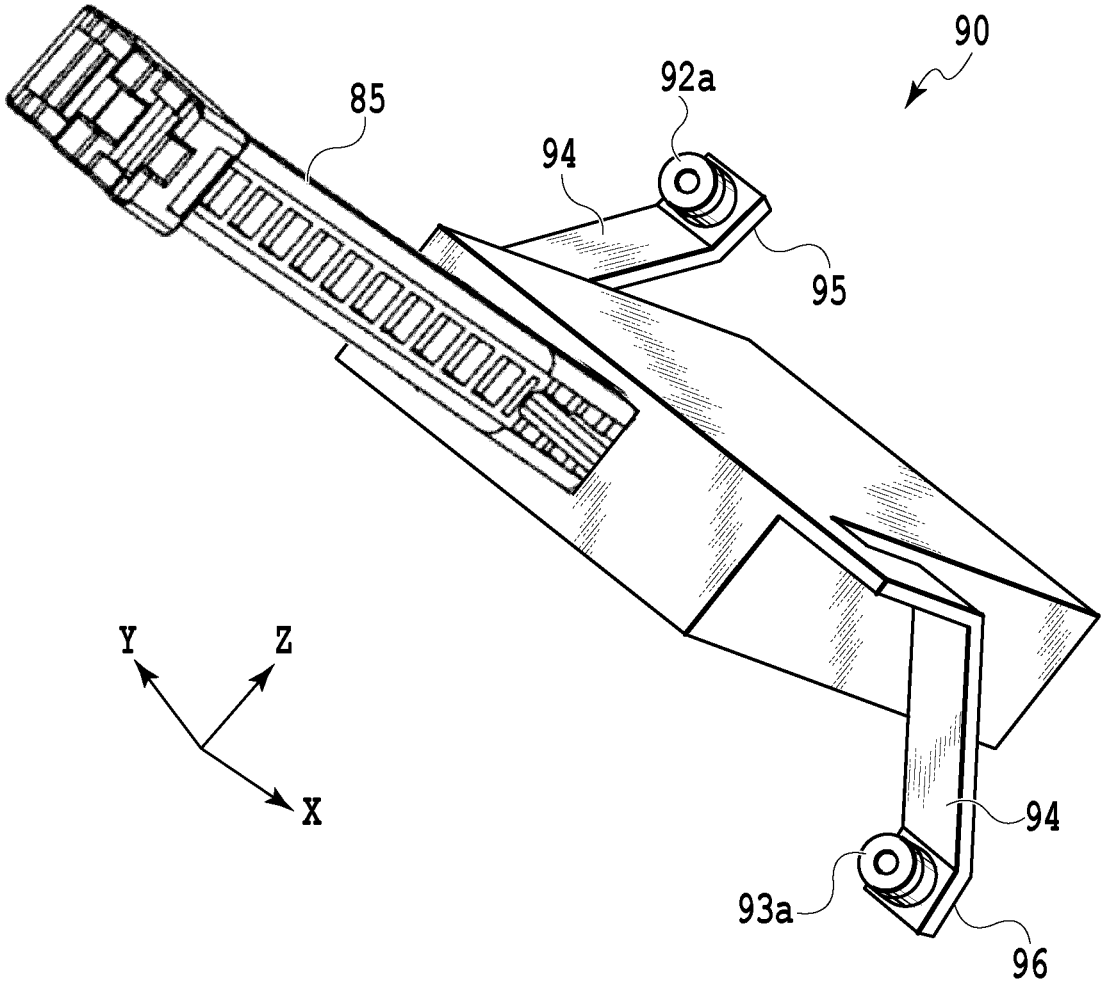
FIG. 9 is a schematic perspective view of a spacer member.

FIG. 9 is a perspective view of the spacer member 90 of this embodiment. The low rigidity portions 94 are provided at two ends in the width direction of the spacer member 90. FIGS. 10A to 10F show states of the liquid container bag 60 and the spacer member 90 in the process of liquid consumption.

Figure 10A:
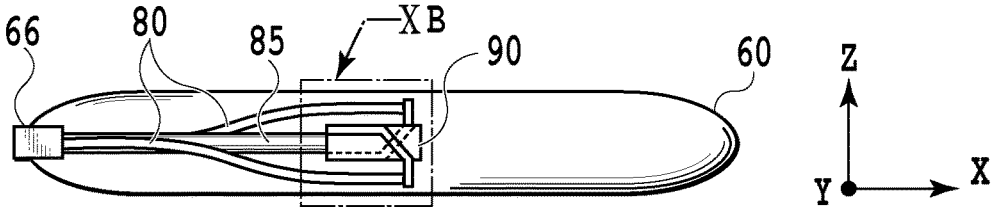
FIGS. 10A to 10F are schematic diagrams showing a deformation process of the liquid container bag.
Figure 10B:
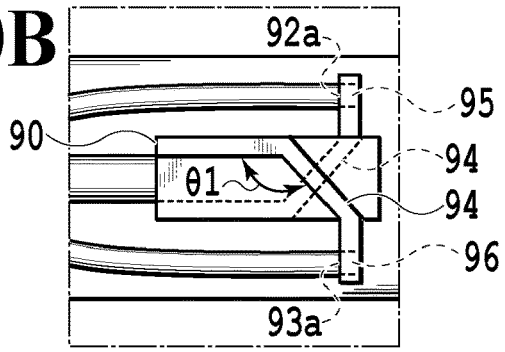

FIG. 10B shows an enlarged view of FIG. 10A. FIGS. 10A and 10B show an initial state where an angle θ formed between the spacer member 90 and each low rigidity portion 94 is equal to an angle θ1. Here, the angle θ1 is an obtuse angle. Meanwhile, in this initial state, the liquid introducing portions 95 and 96 provided to the low rigidity portions 94 are oriented in the +x direction.

Figure 10C:
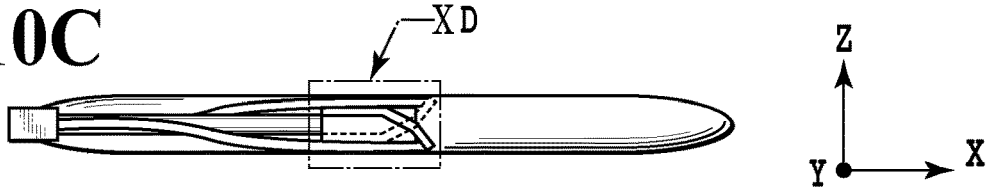
Figure 10D:
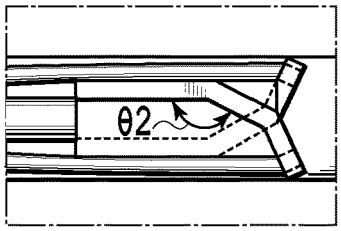

FIG. 10C shows a state where about a half of the ink is consumed. FIG. 10D shows an enlarged view of FIG. 10C. Here, each low rigidity portion 94 is deformed to an angle θ2 due to the deformation of the liquid container bag 60. Although angles of other portions of the low rigidity portion 94 are also changed along with the contraction of the liquid container bag 60, the description will be given below while focusing only on the angle θ as a variable angle in order to simplify the explanation. Even if the liquid container bag 60 is deformed along with the consumption of the liquid as shown in FIG. 10C, the liquid introducing portions 95 and 96 are oriented inward (the −z direction on the part of the liquid introducing portion 95 and the +z direction on the part of the liquid introducing portion 96) owing to the movable low rigidity portions 94, and are less likely to be blocked by the liquid container bag 60. Here, if the value of the angle θ2 falls below the angle θ1 in the initial state, the liquid introducing portions 95 and 96 are oriented outward (the +z direction on the part of the liquid introducing portion 95 and the −z direction on the part of the liquid introducing portion 96) and are likely to be blocked by the liquid container bag 60. Accordingly, the value of the angle θ2 is set larger than the value of the angle θ1 in the initial state as shown in FIG. 10C, and the value of the angle θ is inversely proportional to the amount of the liquid in the liquid container bag 60 in any state.

Figure 10E:
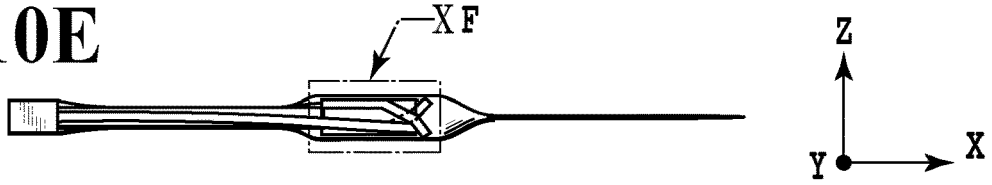
Figure 10F:
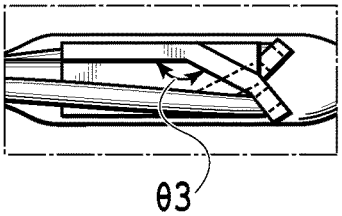
Figure 11A:
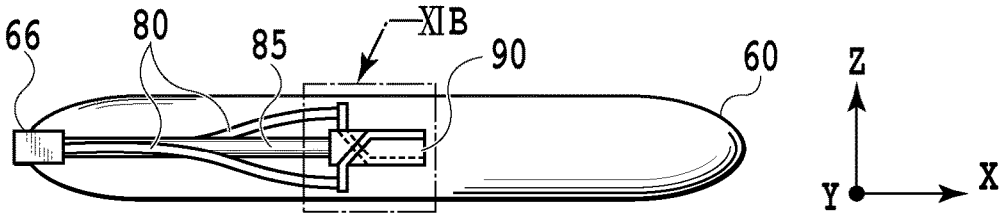
FIGS. 11A to 11D are schematic diagrams showing a modified example of the liquid container bag.
Figure 11B:
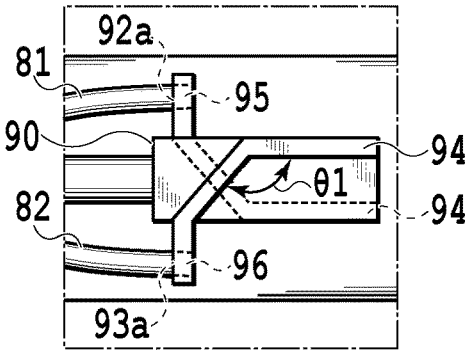
Figure 11C:
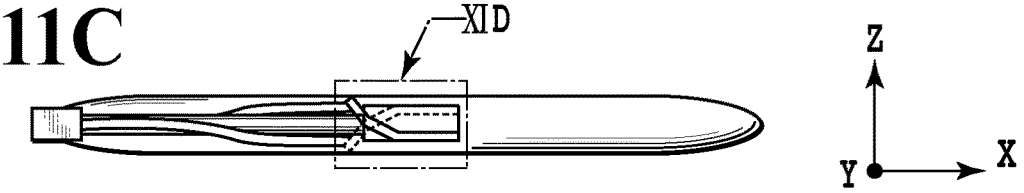
Figure 11D:
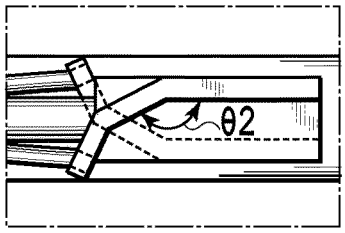

FIG. 10E shows a state where the ink is depleted. FIG. 10F shows an enlarged view of FIG. 10E. Here, each low rigidity portion 94 is deformed to an angle θ3 due to the deformation of the liquid container bag 60. This state represents a maximum value of the angle θ.

As described above, in any of the states of the deformation process of the liquid container bag 60 in FIGS. 10A to 10F, the liquid introducing portions 95 and 96 are oriented inward, thereby being less likely to be blocked by the liquid container bag 60, so that the liquid can be supplied in a stable concentration balance. Moreover, since the difference in height between the liquid introducing portions 95 and 96 is optimized, the portions of the liquid having the difference in concentration can be supplied more appropriately.

Note that it is also possible to adopt a configuration of the low rigidity portions 94 designed to deform the liquid introducing portions 95 and 96 outward as shown in FIGS. 11A to 11D. In this aspect, at least the liquid introducing portion 96 is opposed to a bottom part of the liquid container bag 60 due to the deformation of the low rigidity portions 94. Accordingly, it is easier to take out the ink from the bottom part. Note that the liquid introducing portions 95 and 96 of this configuration are opposed to the liquid container bag 60 and the openings thereof tend to be closed easily. However, it is possible to avoid a situation where the liquid container bag 60 completely closes the openings of the liquid introducing portions 95 and 96 since tip end portions of the low rigidity portions 94 connected to the liquid delivery tubes 80 cone into contact with the liquid container bag 60. As a consequence, there is no particular problem in light of ink supply performances.

Meanwhile, a configuration to connect the liquid delivery member 66 directly to the spacer member 90 without using the connecting member 85 that plays the role for connecting the liquid delivery member 66 to the spacer member 90 is also acceptable to this embodiment.

OTHER EMBODIMENTS

The first and second embodiments have described the case of providing the two liquid introducing portions for introducing the liquid in the liquid container bag into the liquid delivery member. However, the present invention is not limited only to this configuration. For example, two liquid introducing portions may be provided at each of the two ends of the spacer member, so that four openings may be provided in total. Then, flow passages to join portions of a liquid introduced from high concentration liquid introducing portions and to feed the portions of the liquid thus joined together out to the liquid delivery tube may be formed inside the spacer member. Meanwhile, flow passages to join portions of the liquid introduced from low concentration liquid introducing portions and to feed the portions of the liquid thus joined together out to the liquid delivery tube may be formed likewise. On the other hand, in a case of introducing a large amount of the portion of the liquid at a high concentration, the openings for introducing the portion of the liquid at the high concentration may be installed in a larger number than the number of the openings to introduce the portion of the liquid at a low concentration while disposing two or more liquid delivery tubes, for example.

According to the present invention, the liquid can be supplied at a stable concentration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-218730, filed Dec. 28, 2020, which is hereby incorporated by reference wherein in its entirety.

What is claimed is:

1. A liquid container comprising:

a liquid container bag configured to contain a liquid;

a spacer member disposed inside the liquid container bag;

a plurality of liquid introducing portions disposed in the spacer member and configured to introduce the liquid;

a liquid delivery member fixed to one end portion of the liquid container bag and configured to deliver the liquid introduced from the liquid introducing portions to a liquid ejecting apparatus;

a low rigidity portion configured to change heights of the liquid introducing portions along with deformation of the liquid container bag; and a connecting member including the low rigidity portion at least in part of the connecting member and configured to connect the liquid delivery member to the spacer member, wherein the liquid container supplies the liquid to the liquid ejecting apparatus when the liquid container is attached to the liquid ejecting apparatus, the spacer member is configured such that the plurality of liquid introducing portions each form a prescribed inclination relative to a horizontal plane in a state where the liquid is contained in the liquid container bag, and the heights of the plurality of liquid introducing portions are changed by turning the spacer member axially around the low rigidity portion.

2. The liquid container according to claim 1, wherein the plurality of liquid introducing portions include at least a first liquid introducing portion and a second liquid introducing portion, and a position of the first liquid introducing portion is higher than a position of the second liquid introducing portion in a state where the liquid is contained in the liquid container bag.

3. The liquid container according to claim 1, wherein the liquid introducing portions are located at two ends in a width direction of the spacer member, respectively, the width direction being a direction orthogonal to a direction of extension of the liquid delivery member.

4. The liquid container according to claim 3, wherein a height in the width direction between the two ends of the spacer member is equal to a height of the liquid container bag containing the liquid in an initial filled state.

5. The liquid container according to claim 1, wherein the liquid delivery member joins portions of the liquid from the liquid introducing portions, and supplies the joined portions of the liquid to the liquid ejecting apparatus.

6. The liquid container according to claim 1, wherein the liquid container bag contains the liquid containing a precipitate component.

7. A liquid container comprising:

a liquid container bag configured to contain a liquid;

a spacer member disposed inside the liquid container bag;

a plurality of liquid introducing portions disposed in the spacer member and configured to introduce the liquid; and a liquid delivery member fixed to one end portion of the liquid container bag and configured to deliver the liquid introduced from the liquid introducing portions to a liquid ejecting apparatus, wherein the spacer member has a plurality of low rigidity portions on both sides in a width direction, and the plurality of liquid introducing portions are provided at tip portions of the plurality of low rigidity portions, respectively, and the low rigidity portions are connected to the spacer member at an angle θ1, and as the liquid is consumed and the liquid container bag is crushed, the liquid container bag deforms such that the angle θ1 increases to an angle θ2, and heights of the plurality of liquid introducing portions change.

8. The liquid container according to claim 7, wherein the liquid introducing portions at the tip portions of the low rigidity portions deform toward an inside of the liquid container bag according to displacement of the low rigidity portions.

9. The liquid container according to claim 7, wherein the liquid introducing portions at the tip portions of the low rigidity portions deform toward an outside of the liquid container bag according to displacement of the low rigidity portions.

* * * * *